United States Patent [19]

Mayer

[11] Patent Number: 4,778,575

[45] Date of Patent: Oct. 18, 1988

[54] ELECTRODEPOSITION OF MAGNESIUM AND MAGNESIUM/ALUMINUM ALLOYS

[75] Inventor: Anton Mayer, Los Alamos, N. Mex.

[73] Assignee: The United States of America as represented by the United States Department of Energy, Washington, D.C.

[21] Appl. No.: 146,626

[22] Filed: Jan. 21, 1988

[51] Int. Cl.[4] ..... C25D 11/08

[52] U.S. Cl. ..... 204/58.5

[58] Field of Search ..... 204/67, 70, 71, 58.5

[56] References Cited

U.S. PATENT DOCUMENTS

| | | | |
|---|---|---|---|
| 3,502,553 | 3/1970 | Gruber | 204/71 |
| 3,520,780 | 7/1970 | Findl et al. | 204/3 |
| 3,951,764 | 4/1976 | King | 204/71 |
| 4,360,404 | 11/1982 | Stueger et al. | 204/58.5 |
| 4,417,954 | 11/1983 | Birkle et al. | 204/14 N |

OTHER PUBLICATIONS

K. Lui et al., "Research and Development of Magnesium/Aluminum Electroforming Process for Solar Concentrators," National Aeronautics and Space Administration report NASA CR-66427.

Jean H. Connor et al., "Electrodeposition of Metals from Organic Solutions v. Electrodeposition of Magnesium and Magnesium Alloys," J. of the Electrochemical Soc. 104 No. 1, 38–41 (Jan. 1957).

Abner Brenner, "Note on the Electrodeposition of Magnesium from an Organic Solution of a Magnesium–Boron Complex," J. of Electrochem. Soc.: Electrochemical Science 118 No. 1, 99–100 (Jan. 1971).

A. Brenner et al., "Electrodeposition of Magnesium and Beryllium from Organic Baths," Trans. of the Institute of Metal Finishing 49, 71–78 (1971).

*Primary Examiner*—R. L. Andrews

*Attorney, Agent, or Firm*—Richard J. Cordovano; Paul D. Gaetjens; Judson R. Hightower

[57] ABSTRACT

Electrolytes and plating solutions for use in processes for electroplating and electroforming pure magnesium and alloys of aluminum and magnesium and also electrodeposition processes. An electrolyte of this invention is comprised of an alkali metal fluoride or a quaternary ammonium halide, dimethyl magnesium and/or diethyl magnesium, and triethyl aluminum and/or triisobutyl aluminum. An electrolyte may be dissolved in an aromatic hydrocarbon solvent to form a plating solution. The proportions of the component compounds in the electrolyte are varied to produce essentially pure magnesium or magnesium/aluminum alloys having varying selected compositions.

11 Claims, No Drawings

ELECTRODEPOSITION OF MAGNESIUM AND MAGNESIUM/ALUMINUM ALLOYS

This invention is the result of a contract with the Department of Energy (Contract No. W-7405-ENG-36).

BACKGROUND OF THE INVENTION

This invention relates to the field of electrochemistry. More specifically, it relates to the electrodeposition of reactive metals.

Magnesium and aluminum cannot be electrodeposited from aqueous solutions because their electrode potentials are higher than that of hydrogen. The electrodeposition of aluminum from organic solutions is a well-developed art. But, since pure electrodeposited aluminum has a relatively low yield strength and modulus of elasticity, it is desirable to combine it with metals such as magnesium to provide an alloy having improved mechanical properties. Alternatively, magnesium may be used in many applications in place of aluminum. However, as stated in the book *Modern Electroplating,* 3rd Edition, (edited by F. A. Lowenhein, John Wiley & Sons, Inc., 1974), no practical method of depositing magnesium from nonaqueous solutions has been developed, even though it is possible to electrodeposit magnesium from solutions comprising a type of Grignard reagent. Also, electrodeposition of sound magnesium/aluminum alloys had not been achieved until the present invention. There are numerous potential applications for electrodeposited magnesium and magnesium/aluminum alloys; among the most important are those involving extraterrestrial activities and national defense programs.

The publications listed below may be consulted for additional background information.

1. Siegfried Brikle and Klaus Stöger. "Electrolyte For The Electrodeposition Of Aluminum," U.S. Pat. No. 4,417,954, November 1983. This patent teaches an organometallic electrolyte for the electrodeposition of aluminum which is a complex formed of potassium, rubidium, or cesium fluoride in combination with triethyl aluminum and another organic aluminum compound.

2. Eugene Findl, Monsoor A. Ahmadi and Kenneth Lui, "Magnesium Electrodeposition," U.S. Pat. No. 3,520,780, July 1970. This patent provides an example of a method of electrodepositing magnesium from electrolytes comprising magnesium Grignard compounds. The patent teaches the continuous addition of an alkyl halide to the plating solution while electrodeposition is taking place, at a rate sufficient to dissolve sponge-like magnesium electrodeposits but low enough to avoid corroding the electrodeposited magnesium which is not sponge-like.

3. K. Lui, R. Guidotti, and M. Klein, "Research And Development Of Magnesium/Aluminum Electroforming Process For Solar Concentrators," National Aeronautics And Space Administration report NASA CR-66427. This report provides information on a research and development program to develop magnesium-/aluminum electroforming processes and teaches the continuous alkyl halide addition of the above-mentioned U.S. Pat. No. 3,520,780. Magnesium was electrodeposited from an ethereal solution of a magnesium Grignard. Attempts to plate magnesium/aluminum alloys were unsuccessful.

4. Jean H. Connor, Walter E. Reid, Jr., and Gwendolyn B. Wood, "Electrodeposition Of Metals From Organic Solutions v. Electrodeposition Of Magnesium And Magnesium Alloys," J. of the Electrochemical Soc. 104 No. 1, 38–41 (January 1957). The electrodeposition of magnesium from ether solutions of such magnesium compounds as halides, aluminohydrides, borohydrides, and Grignard reagents was investigated by the authors. Efforts to electrodeposit pure magnesium and magnesium/aluminum alloys were unsuccessful.

5. Abner Brenner, "Note On The Electrodeposition Of Magnesium From An Organic Solution Of A Magnesium-Boron Complex," J. of Electrochem. Soc.: Electrochemical Science 118 No. 1, 99–100 (January 1971). This paper teaches an electrolyte consisting of a magnesium alkyl halide complexed with dicarborane or alkyl boranes in an ether or tetrahydrofuran solvent, from which magnesium containing a small amount of boron was electrodeposited.

6. A. Brenner and J. L. Sligh, "Electrodeposition Of Magnesium And Beryllium From Organic Baths," Trans. of the Institute of Metal Finishing 49, 71–78 (1971). This paper reports that solutions for electrodepositing magnesium were prepared from Grignard reagents and boranes in either solutions. A typical bath consisted of methylmagnesium chloride and triethyl boron in tetrahydrofuran and yielded deposits which were at least 99% magnesium.

SUMMARY OF THE INVENTION

This invention is electrolytes and plating solutions for use in processes for electroplating and electroforming pure magnesium and alloys of aluminum and magnesium and also is said electrodeposition processes. An electrolyte of this invention is comprised of an alkali metal fluoride or a quaternary ammonium halide, one or two alkyl magnesium compounds, and one of two alkyl aluminum compounds. In a preferred embodiment, an electrolyte may be dissolved in an aromatic hydrocarbon solvent to form a plating solution. Alternatively, a plating solution may consist only of an electrolyte. The proportions of the component compounds in the electrolyte are varied to produce essentially pure magnesium or magnesium/aluminum alloys having varying selected compositions.

When dimethyl or diethyl magnesium is mixed with an alkali metal fluoride or quarternary ammonium halide of this invention, the resultant mixture cannot be used as an electrolyte. It was unexpected and surprising that addition of triethyl and/or triisobutyl aluminum to the mixture provided an electrolyte for electrodepositing magnesium. Also unexpected was the discovery that pure magnesium or magnesium/aluminum alloys of widely varying selected compositions could be obtained by varying the composition of the inventive electrolyte. Further, it was discovered that changes in temperature of the plating bath influence the composition and quality of the electrodeposit.

An object of this invention is to provide practical organic solvent-based electrolytes for electrodepositing sound and coherent magnesium and magnesium-/aluminum alloys. The plating solutions of this invention make it feasible to electrodeposit sound and essentially pure Mg and Mg/Al alloys from organometallic complexed electrolytes dissolved in aromatic solvents. These solutions are readily prepared from inexpensive commercially available chemicals, are stable both chemically and electrochemically, and offer a significant improvement over magnesium plating solutions based on magnesium Grignard reagents with ether-type solvents. The electrolytes of this invention are useful for fabricating strong light-weight structures by electroforming techniques, as a result of the high strength to weight ratio of magnesium and the inherently higher strengths of Mg/Al alloys are compared to the pure metals. The Mg/Al alloy deposits may also be useful, in part because of their higher hardness than the pure metals, as engineering coatings on base metals for corrosion protection and decorative applications.

An electrolyte of this invention is comprised of (a) an alkali metal fluoride or a quaternary ammonium halide selected from a group consisting of sodium fluoride, potassium fluoride, rubidium fluoride, cesium fluoride, tetramethyl ammonium chloride, and tetramethyl ammonium fluoride; (b) dimethyl magnesium or diethyl magnesium or both dimethyl magnesium and diethyl magnesium; and (c) triethyl aluminum or triisobutyl aluminum or both triethyl aluminum and triisobutyl aluminum.

DETAILED DESCRIPTION OF THE INVENTION

Electrolytes of the present invention are comprised of three components, as follows:

A. An alkali metal fluoride or a quaternary ammonium halide selected from a group consisting of sodium fluoride, potassium fluoride, rubidium fluoride, cesium fluoride, tetramethyl ammonium chloride, and tetramethyl ammonium fluoride;

B. A magnesium component consisting of dimethyl magnesium of diethyl magnesium or both dimethyl magnesium and diethyl magnesium; and C. An aluminum component consisting of triethyl aluminum or triisobutyl aluminum or both triethyl aluminum and triisobutyl aluminum.

The amounts of each component used in the practice of the present invention are those amounts which are effective in electrodepositing magnesium and alloys of magnesium and aluminum. It is expected that effective amounts are within the following ranges: for each mole of component A, from about 0.5 moles to about 4 moles of component B, and from about 2 moles to about 8 moles of component C. However, it is intended to include amounts outside these ranges within the scope of the present invention.

In a preferred embodiment, the electrolyte is combined with an aromatic hydrocarbon, in an amount ranging from 0.1 to about 15 moles of hydrocarbon per mole of component A. More commonly, the amount of hydrocarbon solvent present in a plating solution of this invention will be greater than 2 moles and no more than 10 moles per mole of component A. Toluene is preferred, but other aromatic hydrocarbons, such as xylenes and benzene may be used.

In order to electrodeposit essentially pure magnesium, the experiments conducted indicate that the ratio of component B to component C should be 1 mole of B to about 3.5 moles or less of C. The amount of aromatic hydrocarbon solvent used in experiments in which essentially pure magnesium was electrodeposited varied from about 3 to about 6 moles per mole of component A; however, it may be possible to use more or less solvent. In order to electrodeposit a magnesium/aluminum alloy, the experiments conducted indicate that the ratio should be 1 mole of component B to about 4 moles or more of component C. Since there are a number of parameters which may be varied in carrying out an electrodeposition process, the quantities mentioned above are approximate and not intended to be limiting to the scope of the present invention.

An electrolyte of the present invention may be prepared by combining the alkyl magnesium, which is commercially available in a mixture with diethyl ether, with the alkyl alumium and slowly heating to about 100° C. to boil off the ether. The aromatic hydrocarbon is then added, followed by slow addition of the alkali metal fluoride or quaternary ammonium halide. The electrolyte is heated and stirred throughout the preparation procedure in order to form the complex salts which are the conductive species in the electrolyte.

An alternate bath preparation technique is to combine the alkyl magnesium with at least an equal molar quantity of the alkyl aluminum in the same manner as described above and then to combine the resultant solution with a separately formed solution of the alkyl aluminum and the alkyl metal fluoride or quaternary ammonium halide.

Direct current was used in the experiments, but it is expected that pulsed direct current of alternating current with periodic reverse current cycling may be used. Cell voltages ranged between 1 to 5 V, yielding current densities of 1 to 2 A/dm$^2$.

It is desirable to moderately agitate the electrolyte during electrolysis. Anodes of the electrodeposited metal may be used in order to replenish the electrolyte or inert anodes, such as copper or platinum, may be used. The electrolyte should be filtered, either continuously or periodically, in order to remove fine particulate matter which could cause rough metal deposits. Because of the reactive properties with oxygen and water of the organometallic compounds used in this invention, it is necessary that operations be carried out under dry nitrogen or argon.

Attempts were made to form complexes of magnesium alkyls and alkali metal fluorides analogous to the organoaluminum plating systems that form conductive ionic species when dissolved in an appropriate organic solvent. Complex formation did not occur. The alkali metal fluorides did not react with the alkyl magnesium in either diethyl ether or aromatic solvents. These solutions showed no conductivity of 29 V cell potential and no deposition took place, while the plating baths of this invention may be operated at 1 to 5 V cell potential. When aluminum alkyls were added to the above-mentioned magnesium alkyl/alkali metal fluoride solutions, a rapid reaction did take place; it is probable that a complex of all three compounds were formed. When these three-component solutions were electrolyzed, coherent deposits of magnesium and magnesium-/aluminum alloys were obtained. That addition of an aluminum compound caused electrodeposition of magnesium was quite surprising.

The temperature of the plating bath is a parameter which can be manipulated to influence the character of the metal electrodeposited from a plating bath of this invention. For a specific bath composition, magnesium content of a deposited alloy will increase as bath temperature increases. For examply, alloy consisting of 10 at. % magnesium and 90 at. % aluminum was obtained from a particular bath. Increasing bath temperature while maintaining a constant bath composition resulted in a smooth curve when bath temperature versus Mg composition was plotted. The experimentation was terminated at a temperature of 100° C., at which point the deposited metal contained 30 at. % Mg and 70 at. % Al. The low temperature of the curve extended to about 2 at. % Mg at about 25° C.

The best deposits of high aluminum content alloys (80–99% at. % Al) were obtained at temperatures ranging from 80° to 110° C. When alloys containing less than 80 at. % Al were deposited, better results were obtained at 50° to 80° C.

Deposits of pure magnesium were sound and smooth when plated from a bath at temperatures ranging between 40° to 70° C.; good deposits were also obtained with temperatures ranging down to 22° C. High dendritic deposits resulted when pure magnesium was deposited at bath temperatures between 80° and 100° C.

When the electrodeposited alloys had compositions between 10 and 90 at. % of both metals and were deposited at favorable temperatures as discussed above, the deposits were smooth and bright. Outside of these limits, the deposits remained smooth but were mat gray in color. Bright deposits are typically more dense and coherent and therefore more desirable.

A quaternary ammonium halide is a central nitrogen atom joined to five entities consisting of four organic groups and a halide.

The mole ratio of a component of a mixture is the number of moles of that component present in the mixture divided by the total number of moles of all components in the mixture. The mole ratio may be adjusted such that the mole ratio of one component is 1, even the number of moles of that component actually present in an electrolyte is more or less than 1 mole.

When a substance is referred to as essentially pure magnesium, it is meant that the substance contains about 99 atomic % magnesium or more.

An electrolyte is a plating solution; however, a plating solution may be comprised of substances in addition to an electrolyte or substances which together form an electrolyte. It is common that a plating solution consists of an electrolyte dissolved in a solvent.

Electrodeposition may be electroforming or electroplating. In electroforming, the electrodeposited material is deposited onto a mandrel which is later removed. In electroplating, a layer of electrodeposited material covers a substrate material.

The following examples are presented to further explain the invention.

EXAMPLE 1

Several plating baths of the following composition were prepared:

| Component | Mole Ratio |
|---|---|
| CsF | 1 |
| $(C_2H_5)_2$ Mg (in ether) | 2 |
| $(C_2H_5)_3$ Al | 4 |
| iso$(C_4H_9)_3$ Al | 2 |
| Toluene | 3 |

Brass panels were electroplated in this solution at 1 A/dm$^2$ under moderate agitation. A gold plated copper anode was used. With high bath teperatures (80° to 100° C.) highly dendritic deposits were obtained. At low bath temperatures (22° to 42° C.), smooth fine grained deposits were obtained. X-ray fluorescence spectroscopy showed these deposits to be essentially pure magnesium.

In further experimentation with the electrolyte of Example 1, a foil was electroformed on a mandrel. Analysis by inductively coupled plasma atomic emission spectroscopy and mass spectroscopy of the foil showed the deposit to be of the following composition (weight %). Note that these are the numbers reported before normalization to eliminate the over 100% total.

Mg=99.75
Al=0.37
Cs=0.10
Si=0.06
Na, K, W, Cu=trace amounts

EXAMPLE 2

A plating bath of the following composition was prepared:

| Component | Mole Ratio |
|---|---|
| $(CH_3)_4$ NCl | 1 |
| $(C_2H_5)_2$ Mg | 1 |
| $(C_2H_5)_3$ Al | 3 |
| iso$(C_4H_9)_3$ Al | 1 |
| Toluene | 5 |

High purity magnesium bars were used as anodes. Brass cathodes plated in this solution at 1 A/dm$^2$ and between 30° to 50° C. produced large grained light gray deposits. The deposits were essentially pure Mg, as analyzed by x-ray fluoresence spectroscopy.

EXAMPLE 3

A plating bath of the following composition was prepared:

| Component | Mole Ratio |
|---|---|
| KF | 1 |
| $(C_2H_5)_2$ Mg | 0.5 |
| $(C_2H_5)_3$ Al | 3 |
| iso$(C_4H_9)_3$ Al | 1 |
| Toluene | 3 |

A brass panel plated in this bath at 1 A/dm$^2$ and 90° C. produced an alloy deposit of the approximate composition 5% Mg/95% Al (atomic %) as determined by x-ray fluorescence spectroscopy.

EXAMPLE 4

A plating bath of the following composition was prepared:

| Component | Mole Ratio |
|---|---|
| KF | 1 |
| $(C_2H_5)_2$ Mg | 0.67 |
| $(C_2H_5)_3$ Al | 2.5 |
| iso$(C_4H_9)_3$ Al | 0.83 |
| Toluene | 1.5 |

A brass panel plated in this bath at 1 A/dm$^2$ and 109° C. produced a bright deposit of the approximate composition 50% Mg/50% Al (atomic %) as analyzed by x-ray fluorescence spectroscopy.

EXAMPLE 5

A plating bath of the following composition was prepared:

| Component | Mole Ratio |
|---|---|
| KF | 1 |
| $(C_2H_5)_2$ Mg | 1 |
| $(C_2H_5)_3$ Al | 3 |
| iso$(C_4H_9)_3$ Al | 1 |
| Toluene | 3 |

A brass panel plated in this bath at 1 A/dm$^2$ and 45° C. produced a deposit having an approximate composition of 98% Mg/2% Al (atomic %).

EXAMPLE 6

A plating bath of the approximate following composition was prepared:

| Component | Mole Ratio |
|---|---|
| NaF | 1 |
| $(C_2H_5)_2$ Mg | 0.8 |
| $(C_2H_5)_3$ Al | 1.8 |
| iso$(C_4H_9)_3$ Al | 0.6 |
| Toluene | 3 |

A deposit from this bath plated at 1 A/dm$^2$ and 99° C. was essentially pure Mg. To this bath, quantities of a solution comprised of sodium fluoride and triethyl aluminum were added in increments and the compositions of the resulting incremental deposits analyzed after each addition. The composition of deposited metal shifted from an essentially pure Mg deposit to an essentially pure Al deposit as increasing quantities of the solution were added.

EXAMPLE 7

Plating baths of the following composition were prepared:

| Component | Mole Ratio |
|---|---|
| CsF | 1 |
| $(C_2H_5)_2$ Mg (in ether) | 2 |
| $(C_2H_5)_3$ Al | 4 |
| iso$(C_4H_9)_3$ Al | 3 |
| Toluene | 3 |

Brass panels were electroplated in these baths at about 1 A/dm$^2$ under moderate agitation. Gold plated copper wire anodes were used. With high bath temperatures (80° to 100° C.), very dendritic deposits were obtained. At low bath temperatures (22° to 42° C.), smooth fine-grained deposits were obtained. X-ray fluorescence spectroscopy showed these deposits to be essentially pure magnesium.

The foregoing description of the invention has been presented for purposes of illustration and description. It is not intended to be exhaustive or to limit the invention to the precise form disclosed, since many modifications and variations are possible in light of the above teaching. The examples were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An electrolyte for electrodepositing magnesium or alloys comprised of magnesium and aluminum, said electrolyte comprising, in amounts effective for deposition of said metals:

a. an alkali metal fluoride or a quaternary ammonium halide selected from a group consisting of sodium fluoride, potassium fluoride, rubidium fluoride, cesium fluoride, tetramethyl ammonium chloride, and tetramethyl ammonium fluoride;

b. dimethyl magnesium or diethyl magnesium or both dimethyl magnesium and diethyl magnesium; and c. triethyl aluminum or triisobutyl aluminum or both triethyl aluminum and triisobutyl aluminum.

2. An electrolyte or claim 1 wherein the mole ratio of said alkali metal fluoride or quaternary ammonium halide is 1, the mole ratio of said magnesium component varies from about 0.5 to about 4, and the mole ratio of said aluminum component varies from about 2 to about 8.

3. An electrolyte of claim 1 in combination with a liquid aromatic hydrocarbon, whereby a plating solution is formed.

4. A plating solution of claim 3 wherein said aromatic hydrocarbon is present in a mole ratio of from about 0.1 to about 15.

5. An electrolyte of claim 1 in combination with toluene.

6. An electrolyte of claim 1 from which essentially pure magnesium is electrodeposited.

7. A plating solution comprising an electrolyte of claim 6 and toluene, wherein toluene is present in a mole ratio of from about 3 to about 6.

8. A plating solution consisting of an electrolyte of claim 1 and toluene, wherein the mole ratio of said alkali metal fluoride or quaternary ammonium halide is 1, the mole ratio of the magnesium component varies from about 2 to about 4, the mole ratio of the aluminum component varies from about 2 to about 6, and the mole ratio of toluene varies from about 2 to about 10.

9. A method for electrodepositing magnesium or alloys comprised of magnesium and aluminum, said method comprising passing electric current through a plating bath comprising an electrolyte, thereby electrodepositing magnesium or alloys comprised of magnesium and aluminum at a negative electrode, where said electrolyte is comprised of:

a. an alkali metal fluoride or a quaternary ammonium halide selected from a group consisting of sodium fluoride, potassium fluoride, rubidium fluoride, cesium fluoride, tetramethyl ammonium chloride, and tetramethyl ammonium fluoride;

b. dimethyl magnesium or diethyl magnesium; and c. triethyl aluminum or triisobutyl aluminum or both triethyl aluminum and triisobutyl aluminum.

10. The method of claim 9 wherein said plating bath is further comprised of an aromatic hydrocarbon.

11. The method of claim 9 wherein a positive electrode is comprised of magnesium or alloys of magnesium and aluminum.

* * * * *